US006164455A

United States Patent [19]

Kakita et al.

[11] Patent Number: 6,164,455

[45] **Date of Patent: *Dec. 26, 2000**

[54] PROCESS FOR CLASSIFYING PARTICULATE HYDROPHILIC POLYMER AND SIEVING DEVICE

[75] Inventors: Hiroyuki Kakita, Himeji; Tatsuo Maruo; Sumio Okuda, both of Hyogo; Takumi Hatsuda, Takasago, all of Japan

[73] Assignee: Nippon Shokubai Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/009,458

[22] Filed: Jan. 20, 1998

[30] Foreign Application Priority Data

Jan. 27, 1997 [JP] Japan ..... 9-012927

[51] Int. Cl.[7] ..... B07B 1/00; B07B 1/46

[52] U.S. Cl. ..... 209/11; 209/235; 209/238

[58] Field of Search ..... 209/238, 11, 235

[56] References Cited

U.S. PATENT DOCUMENTS

| | | | |
|---|---|---|---|
| 2,808,152 | 10/1957 | Kaufman et al. | 209/238 |
| 2,850,163 | 9/1958 | Scanlon et al. | 209/238 |
| 2,866,551 | 12/1958 | Schlebusch | 209/238 |
| 2,868,378 | 1/1959 | Burstlein | 209/238 |
| 2,984,357 | 5/1961 | Kufferath | 209/238 |
| 3,760,941 | 9/1973 | Singewald | 209/11 |
| 3,831,290 | 8/1974 | Gomez et al. | 209/11 |
| 5,061,735 | 10/1991 | Zielinski | 209/11 |
| 5,358,119 | 10/1994 | Stahl | 209/11 |
| 5,542,548 | 8/1996 | Senapati | 209/365.1 |

FOREIGN PATENT DOCUMENTS

| | | |
|---|---|---|
| 1010522 | 6/1952 | France . |
| 3-56513 | 3/1991 | Japan . |
| 3-170323 | 7/1991 | Japan . |

OTHER PUBLICATIONS

"Heated Screen Cloth Helps Stop Blinding", Engineering and Mining Journal, vol. 152 #8, Aug. 1951.

Takeuchi et al., "On the Characteristics of Some Screening Machines," *Food Processing Technique,* Oct., 1982, pp. 22–37, vol. 2, No. 4, Japan.

*Primary Examiner*—Donald P. Walsh
*Assistant Examiner*—Brett C. Martin

[57] ABSTRACT

The present invention provides a process for classifying a particulate hydrophilic polymer and a sieving device, which can carry out a classification in a small separation particle diameter with high efficiency and exhibit classification ability inherent in the sieving device. The process comprises the step of classifying a particulate hydrophilic polymer in dry particle size with a sieving device, wherein the sieving device is used in a heated and/or thermally insulated state. The sieving device comprises a thermally insulating means.

6 Claims, No Drawings

PROCESS FOR CLASSIFYING PARTICULATE HYDROPHILIC POLYMER AND SIEVING DEVICE

BACKGROUND OF THE INVENTION

A. Technical Field

The present invention relates to a process for classifying a particulate hydrophilic polymer and to a sieving device. More particularly, the invention relates to a process for classifying a particulate hydrophilic polymer in particle size with high accuracy and productivity, and further to a sieving device suitable for such a classification. Examples of the particulate hydrophilic polymer include: water-soluble polymers as favorably used for materials such as flocculants, coagulants, soil improvers, soil stabilizers, and thickeners; and water-absorbent resins which are applied to wide uses, for example, as absorbing agents for sanitary materials (e.g. sanitary napkins and disposable diapers), or as water-holding agents and dehydrators in the agricultural and gardening field and the field of civil engineering works.

B. Background Art

Dry classification such as air classification and sieving are generally employed in classification operations of powdery or granular materials. It is said that the air classification is suited for classifying powdery or granular matters which are so fine that the particle diameter thereof is, for example, not more than 300 μm. However, the air classification has problems in that it requires a large device. In contrast, a device as needed for the sieving is smaller than that as needed for the air classification. However, the sieving has problems in that its classification efficiency is low or its classification ability is inferior for classifying powdery or granular matters which are so fine that the particle diameter thereof is, for example, not more than 300 μm.

Particularly, when particulate hydrophilic polymers are classified by conventional processes, a screen mesh face might be clogged in a short period of operation to deteriorate its classification efficiency and classification ability. In addition, there are problems in that where the separation particle diameter is so small as is not greater than 300 μm, particles of large particle diameter mingle into the resultant product comprising particles of small particle diameter as have passed through a screen mesh face. Especially, sieving devices in which screen mesh faces are driven spirally, e.g., Tumbler-Screening machines as were recently developed by Allgaier Inc., exhibit high classification ability and are available for classifying fine particles. However, as the classification ability of such sieving devices becomes higher, the above-mentioned problems are greater, and it becomes more impossible to make the sieving devices exhibit their inherent high classification ability.

SUMMARY OF THE INVENTION

A. Objects of the Invention

An object of the present invention is to provide a process for classifying a particulate hydrophilic polymer and a sieving device, which can carry out a classification in a small separation particle diameter with high efficiency and exhibit classification ability inherent in the sieving device.

B. Disclosure of the Invention

The present inventors diligently studied about causes that the aforesaid problems occur in the classification of particulate hydrophilic polymers, particularly, those having a small separation particle diameter. As a result, they found that the water content of the particulate hydrophilic polymers causes a cohered matter to form before and after particles pass through a screen mesh face. Specifically, particulate hydrophilic polymers, as have passed through the screen mesh face, adhere to an internal wall face of a sieving device due to the water content to form a large cohered matter, which then falls off due to the vibration of the sieving device, so that particles having a particle diameter greater than the separation particle diameter mingle into the resultant product. Further, where the cohesion occurs before particles pass through the screen mesh face, the clogging thereof gets caused.

Thus, the present inventors found that the above-stated problems are solved by using a sieving device in a heated and/or thermally insulated state in order to inhibit the cohesion as caused by the water content of the particulate hydrophilic polymers. As a result, the present invention was attained.

Thus, a process for classifying a particulate hydrophilic polymer, according to the present invention, comprising the step of classifying a particulate hydrophilic polymer in dry particle size with a sieving device, wherein the sieving device is used in a heated and/or thermally insulated state, or in a temperature range of 30 to 100° C., or at or above a temperature that is lower than a temperature of the particulate hydrophilic polymer by 20° C.

The present invention further provides a sieving device for classifying particles in dry particle size by sieving, which comprises a thermally insulating means.

The present invention is effective where the particulate hydrophilic polymer has a temperature between 40 and 100° C., or where the sieving device has a screen mesh face with a sieve mesh of between 45 and 300 μm.

These and other objects and the advantages of the present invention will be more fully apparent from the following detailed disclosure.

DETAILED DESCRIPTION OF THE INVENTION

Hereinafter, the present invention is described in more detail.

The particulate hydrophilic polymer in the present invention is exemplified with dried and pulverized products of water-soluble polymers and those of water-absorbent resins. The water-soluble polymers are obtained by polymerizing water-soluble monomers containing a polymerizable unsaturated group, for example, the following monomers: anionic monomers, such as (meth)acrylic acid, (anhydrous) maleic acid, fumaric acid, crotonic acid, itaconic acid, 2-(meth) acryloylethanesulfonic acid, 2-(meth) acryloylpropanesulfonic acid, 2-(meth)acrylamido-2-methylpropanesulfonic acid, vinylsulfonic acid, and styrenesulfonic acid, and their salts; monomers containing a nonionic hydrophilic group, such as (meth)acrylamide, N-substituted (meth)acrylamide, 2-hydroxyethyl (meth) acrylate, 2-hydroxypropyl (meth)acrylate, methoxypolyethylene glycol (meth)acrylate, and polyethylene glycol (meth) acrylate; and unsaturated monomers containing an amino group, such as N,N-dimethylaminoethyl (meth)acrylate, N,N-dimethylaminopropyl (meth)acrylate, and N,N-dimethylaminopropyl(meth)acrylamide, and their quaternary products. The water-absorbent resins are obtained by polymerizing the above-mentioned water-soluble monomers, containing a polymerizable unsaturated group, with crosslinking agents for forming a crosslinked structure in the polymerization, for example, the following compounds: compounds having two or more polymerizable unsaturated double bonds per molecule; compounds having per molecule two or more groups reactive upon a functional group, such as an acid group, a hydroxyl group, and an amino group, of the above-mentioned water-soluble monomers; compounds having per molecule one or more unsaturated bonds as well as one or more groups reactive upon the functional group of the above-mentioned monomers; compounds having per molecule two or more sites reactive upon the functional group of the above-mentioned monomers; or hydrophilic high molecules that are capable of forming a crosslinked structure, for example, through a graft bond, in the polymerization of monomer compositions. In general, these particulate hydrophilic polymers are commercially available as a dried and pulverized product and usually have a particle diameter of not greater than 1,000 μm. In the present invention, the term "particulate" is understood to represent particles of the arbitrary shape, for example, spherical, cubic, columnar, plate, scale, bar, needle, or fibrous shape, and of unshaped. In the present invention, the particle diameter of such particles is not greater than 1,000 μm, preferably, not greater than 850 μm.

The present invention relates to an operation of particle size classification among classification operations, namely, to an operation to classify a powdery or granular matter into two or more groups of particles depending on the particle diameter thereof and, in particular, the invention relates to a dry classification as is carried out with no solvent. The dry classification can be grouped into the following two main categories: the air classification and the sieving. The present invention relates to a classification operation using a sieving device with a screen mesh face.

The sieving device as used in the present invention is not especially limited if it has a screen mesh face. Examples thereof include what is grouped into a vibrating screen or a sifter. Examples of the vibrating screen include: inclination-shaped ones, Low-head-shaped ones, Hummer, Rhewum, Ty-Rock, Gyrex, and elliptical vibration (Eliptex). Examples of the sifter include Reciprocating-shaped ones, Exolon-grader, Traversator-sieve, Sauer-meyer, Gyratory sifters, gyro sifters, and Ro-tex screen. These can be subdivided depending on (1) the motion form of a screen mesh face: circle, ellipse, straight line, circular arc, pseudo ellipse, and spiral; (2) the vibration mode: free vibration and forced vibration; (3) the driving manner: eccentric axis, unbalanced weight, electromagnet, and impact; (4) the inclination of a screen mesh face: horizontal type and inclination type; and (5) the installation manner: floor type and pendant type. Among those, a sieving device, such as Tumbler sifters (Tumbler-Screening machines) available from Allgaier Inc., in which its screen mesh face is driven spirally by a combination of the radial inclination (the inclination of a screen mesh to disperse materials from the center to the periphery) with the tangential inclination (the inclination of a screen mesh to control the discharge speed on meshes), is extremely available for classifying relatively fine particles. However, where such a sieving device is applied to the classification of particulate hydrophilic polymers, it significantly involves the above-mentioned problems of the cohesion and thus fails to exhibit its inherent classification ability. Therefore, the application of the present invention is extremely efficient. The application of this invention to sieving devices such as Tumbler sifters allows them to exhibit their inherent feature of being effective for classification of relatively fine particles even when classifying particulate hydrophilic polymers. It is also possible to prevent the problem of the clogging of the screen mesh face or the problem that particles as have passed through the screen mesh face adhere to an internal sidewall of the sieving device to form large cohered matters which then fall off due to the vibration of the sieving device to mingle into the resultant product. If ultrasonic vibration is applied to the screen mesh face of such sieving devices, the classification efficiency can be further enhanced.

In the present invention, it is indispensable to use the sieving device in a heated and/or thermally insulated state, or in the temperature range of 30 to 100° C., or at or above a temperature that is lower than a temperature of the particulate hydrophilic polymer by 20° C. That is, if the temperature of a part contacting with the particulate hydrophilic polymer, especially, a sidewall of the screen mesh face, of the sieving device is controlled to such an extent that the cohesion of the particulate hydrophilic polymer does not occur, then it is possible to suppress the particulate hydrophilic polymer from cohering, therefore effectively preventing a screen mesh face from clogging and thus avoiding a reduction in classification efficiency and classification ability. In addition, it is also possible to prevent the problem that a particulate hydrophilic polymer as has passed through the screen mesh face adheres to an internal sidewall of the sieving device to form large cohered matters which then fall off due to the vibration of the sieving device to mingle into the resultant product. Preferably, the temperature of a sidewall of a molded frame fixing screen meshes instead of the temperature of the screen meshes is raised and/or maintained. Furthermore, it is particularly desirable that the temperature of a sidewall of a final screen mesh face in the classification is raised and/or maintained.

In the present invention, the term "heating" represents positively applying heat. Therefore, the term "a heated state" includes the following cases where: (1) heat is applied to the sieving device so as to raise to a certain temperature in the initial stage, and thereafter no heat is applied; (2) heat is applied to the sieving device constantly, not only in the initial stage. The term "thermally insulating" represents preventing the escape of heat without applying heat, in other words, preventing the temperature from lowering. Therefore, the term "a thermally insulated state" represents cases where it is arranged to prevent the escape of heat in manners, for example, by winding a heat insulator around the sieving device, without applying heat. In the present invention, the sieving device may be used both in "a heated state" and "a thermally insulated state," or may jointly use a heat insulator while applying heat positively.

To put the sieving device in a heated and/or thermally insulated state, a sieving device comprising a heating means and/or a thermally insulating means may be used, or the atmospheric temperature under which the sieving device is placed may be raised. The sieving device comprising a heating means and/or a thermally insulating means, for example, can be readily produced by providing a conventional sieving device with a jacket as the heating means, capable of being heated with electricity or steam, or by winding a heating resistor as the heating means around a conventional sieving device, or by winding a heat insulator (temperature-keeping material) as the thermally insulating means around a conventional sieving device. These production methods can be of course used in combinations of two or more thereof. The heat insulator (temperature-keeping material) as used in the present invention is not especially limited, but examples thereof include: fibrous heat insulators made of materials such as asbestos, rock wool, glass wool, and heatproof inorganic fibers; powdery heat insulators made of materials such as calcium silicate and aqueous perlite; foamed heat insulators made of materials such as polystyrene foam, hard urethane foam, and cellular glass; metallic foil heat insulators; and dead-air space heat insulators such as paper honeycombs.

The sieving device is preferably used in the temperature range of about 30 to about 100° C., more preferably, about 40 to about 90° C. The temperatures below 30° C. cannot produce effects of the present invention. In contrast, the temperatures over 100° C. produce no difference in effect from a temperature of not higher than 100° C. To raise the temperature to such a high one is not only uneconomical but also might give a bad influence to the classification efficiency of the sieving device.

The sieving device is preferably used at or above a temperature that is lower than a temperature of the particulate hydrophilic polymer by 20° C. When handled on an industrial scale, the particulate hydrophilic polymer might be heated to a temperature of higher than room temperature, for example, to a temperature of about 40 to about 100° C., more preferably, about 50 to about 80° C., to ensure the fluidity. Where the sieving device stands below a temperature that is lower than a temperature of the particulate hydrophilic polymer by 20° C., the particulate hydrophilic polymer standing in a heated state is cooled with the sieving device, so the clogging of the screen mesh face might occur, or the polymer might adhere to the internal sidewall of the sieving device to form large cohered matters which then fall off due to the vibration of the sieving device to mingle into the resultant product.

The material of a part contacting with the particulate hydrophilic polymer, especially, a sidewall of the screen mesh face, of the sieving device preferably has a water contact angle of 60° or more and a heat distortion point of 70° C. or higher. If the part, contacting with the particulate hydrophilic polymer, of the sieving device is made of a material satisfying the above-mentioned conditions, it is possible to prevent the particulate hydrophilic polymer from adhering to the internal wall face of the sieving device to form large cohered matters, and therefore further possible to avoid the inconvenience that a product with a desired separation particle diameter is unobtainable due to the cohered matters.

Where the contact angle is less than 60°, the effect of preventing the particulate hydrophilic polymer from adhering might be lowered. Where the heat distortion point is lower than 70° C., the deterioration of the material during the sieving operation might be so significant that the effect of preventing the adhesion could not be displayed stably for a long period of time.

Examples of the material with the above-mentioned preferable properties include synthetic resins such as polyethylene, polypropylene, polyesters, polyamides, fluororesin, polyvinyl chloride, and epoxy resins, and these synthetic resins which are complexed and reinforced with inorganic fillers such as glass, graphite, bronze, and molybdenum disulfide and organic fillers such as polyimide resins.

In addition, among the above-mentioned substances, particularly preferred are fluororesins such as polyethylene tetrafluoride, polyethylene trifluoride, polyethylene trifluorochloride, ethylene tetrafluoride-ethylene copolymers, ethylene trifluorochloride-ethylene copolymers, propylene pentafluoride-ethylene tetrafluoride copolymers, perfluoroalkyl vinyl ether-ethylene tetrafluoride copolymers, and polyvinyl fluoride.

The present invention is effectively applied to a sieving device having a screen mesh face with a sieve mesh of between 45 and 300 μm. As the particle diameter of the particulate hydrophilic polymer becomes smaller, the particulate hydrophilic polymer is more liable to clog the screen mesh face and thus to lower the classification efficiency and classification ability, and further, it more easily occurs that a particulate hydrophilic polymer as has passed through the screen mesh face adheres to the internal sidewall of the sieving device to form large cohered matters which then fall off due to the vibration of the sieving device to mingle into the resultant product. Accordingly, if the present invention is applied to the sieving device having a screen mesh face with a sieve mesh of between 45 and 300 μm, outstanding effects are obtained. Particularly, it is more effective to apply the invention to sieving devices having a screen mesh face with a sieve mesh of between 45 and 250 μm.

As to water-absorbent resins of which the quantity consumed is extremely increasing in recent years among particulate hydrophilic polymers, it is well known in the art that fine powders present in such water-absorbent resins are unfavorable components with regard to the performance and working environment. Thus, if the process of the present invention is incorporated into the production process of particulate water-absorbent resins, it is possible to efficiently remove the fine powders from a large quantity of product, resulting in the outstanding usefulness.

The sieving device, according to the present invention, is a sieving device for classifying particles in dry particle size by sieving and comprises the aforementioned thermally insulating means, and is useful for the classification process of the above-mentioned particulate hydrophilic polymers and can also favorably be used for classifying all other conventional powdery or granular matters, for example, the following: grain such as flour milling; agricultural chemicals such as fertilizers; medicines; ceramics; cements; inorganic salts such as calcium carbonate; dyes; pigments; and resin pellets.

(Effects and Advantages of the Invention)

The present invention involves no problem that the classification efficiency and the classification ability are lowered due to the clogging of a screen mesh face when classifying particulate hydrophilic polymers. In addition, even when the separation particle diameter is so small as is not larger than 300 μm, the present invention involves no problem that a fine particulate hydrophilic polymer, as has passed through a screen mesh face, adheres to an internal wall face of a sieving device to form large cohered matters, which then fall off due to the vibration of the sieving device and therefore cause particles, having a particle diameter greater than the separation particle diameter, to mingle into the resultant product. Accordingly, an extremely efficient classification can be made even in separation particle diameters in which stable classification has so far been difficult to carry out, thus allowing the sieving device to fully display its inherent classification ability.

DETAILED DESCRIPTION OF THE PREFERRED EMBODIMENTS

Hereinafter, the present invention is illustrated in more detail by the following examples of some preferred embodiments in comparison with comparative examples not according to the invention. However, the invention is not limited to the below-mentioned examples.

EXAMPLE 1

Acrylic acid and sodium acrylate were subjected to an aqueous solution polymerization together with trimethylolpropane triacrylate to obtain a hydrogel polymer, which was then subjected to drying and pulverization to obtain a water-absorbent resin powder having an average particle diameter of 250 μm.

The resultant water-absorbent resin powder having a temperature of about 60° C. was supplied to a sieving device at a rate of 100 kg/h. The sieving device as used was what was prepared by covering a rock wool heat insulator onto a lid, a screen mesh frame, and a bottom part of a sieving device, Tumbler-Sifter TSM-1600, available from Allgaier Inc., comprising a screen mesh face with a sieve mesh of 850 μm and a screen mesh face with a sieve mesh of 210 μm, wherein the screen mesh faces were piled on. During the classification, sidewalls of the screen mesh faces of the sieving device, as covered with the heat insulator, had a temperature of 55° C. No trouble occurred during an 8-hour classification operation, thus obtaining a water-absorbent resin powder which had passed through the screen mesh face with a sieve mesh of 210 μm.

EXAMPLE 2

The same procedure as of Example 1 was carried out using the same sieving device as of Example 1, as covered with the rock wool heat insulator, except that a tape heater was wound around the sidewalls of the screen mesh faces of the sieving device to set the temperature of the sidewalls of the screen mesh faces at 75° C.

EXAMPLE 3

The same procedure as of Example 1 was carried out using the same sieving device as of Example 1 except that a tape heater was wound around the sidewalls of the screen mesh faces of the sieving device to set the temperature of the sidewalls of the screen mesh faces at 35° C.

Comparative Example 1

The same procedure as of Example 1 was carried out using the same sieving device as of Example 1 except that no heat insulator was provided to the sieving device, and that the temperature of the sidewalls of the screen mesh faces was 25° C.

EXAMPLE 4

A water-absorbent resin powder having an average particle diameter of 350 μm was obtained in the same way as of Example 1 except that the hydrogel polymer was subjected to drying and pulverization of which the conditions were changed.

The resultant water-absorbent resin powder having a temperature of about 50° C. was supplied to a sieving device at a rate of 150 kg/h. The sieving device as used was what was prepared by covering a tape heater and an asbestos heat insulator onto a lid, a fixing frame, a mesh frame, a case, a drift frame, and an angle frame of a sieving device, Gyro-Sifter GS-B type, available from Tokuju Kosakusho, comprising a screen mesh face with a sieve mesh of 850 μm. During the classification, a sidewall of the screen mesh face of the sieving device, as covered with the heat insulator, had a temperature of 50° C. No trouble occurred during an 8-hour classification operation, thus obtaining a water-absorbent resin powder which had passed through the screen mesh face with a sieve mesh of 850 μm.

Comparative Example 2

The same procedure as of Example 4 was carried out using the same sieving device as of Example 4 except that neither the tape heater nor the asbestos heat insulator was provided to the sieving device, and that the temperature of the sidewall of the screen mesh face was 20° C.

TABLE 1

| | Water-absorbent resin temperature (° C.) | Sieving device temperature (° C.) | Operability |
|---|---|---|---|
| Example 1 | 60 | 55 | ○ |
| Example 2 | 60 | 75 | ○ |
| Example 3 | 60 | 35 | Δ |
| Comparative Example 1 | 60 | 25 | X |
| Example 4 | 50 | 50 | ○ |
| Comparative Example 2 | 50 | 20 | X |

○: There was little adhesion to the screen mesh sidewall and to the screen mesh, and no cohered matter mingled into the product resultant from the classification.
Δ: There was little adhesion to the screen mesh sidewall and to the screen mesh, and a small cohered matter partially mingled into the product resultant from the classification.
X: There was adhesion to the screen mesh sidewall and to the screen mesh, and a cohered matter mingled into the product resultant from the classification.

Various details of the invention may be changed without departing from its spirit not its scope. Furthermore, the foregoing description of the preferred embodiments according to the present invention is provided for the purpose of illustration only, and not for the purpose of limiting the invention as defined by the appended claims and their equivalents.

What is claimed is:

1. A water-absorbent resin particulate sieving process comprising the steps of:

a) selecting water-absorbent resin particulates, with said water-absorbent resin particulates being at a temperature between 40 and 100° C.;

b) supplying a sieving device of which the temperature is maintained at or above a temperature lower than the temperature of said water-absorbent resin particulates by 20° C.; and c) sieving the water-absorbent resin particulates with the mesh of the sieving device, with the step of sieving the water-absorbent resin particulates being conducted while the temperature of the sieving device is maintained at or above a temperature lower than the temperature of said water-absorbent resin particulates by 20° C.

2. A water-absorbent resin particulate sieving process according to claim 1, wherein said water-absorbent resin particulates are not greater than 1000 μm.

3. A water-absorbent resin particulate sieving process according to claim 1, the temperature of an inner portion of said sieving device is maintained at or above a temperature lower than the temperature of said water-absorbent resin particulates by 20° C.

4. A water-absorbent resin particulate sieving process according to claim 1, wherein said sieving device comprises a frame part having a mesh fixed to the frame part and the temperature of the frame part is maintained at or above a temperature lower than the temperature of said water-absorbent resin particulates by 20° C.

5. A water-absorbent resin particulate sieving process according to claim 4, wherein the mesh is sized between 45 and 300 μm.

6. A water-absorbent resin particulate sieving process according to claim 1, further comprising the step of maintaining said sieving device at a temperature between 30 and 100° C.

* * * * *